US006932942B2

(12) United States Patent
Itoh

(10) Patent No.: US 6,932,942 B2
(45) Date of Patent: Aug. 23, 2005

(54) TEST TUBE HOLDER

(76) Inventor: Teruaki Itoh, 5-25, Kokaihommachi, Kumamoto-shi, Kumamoto-ken (JP)

( * ) Notice: Subject to any disclaimer, the term of this patent is extended or adjusted under 35 U.S.C. 154(b) by 415 days.

(21) Appl. No.: 10/335,955

(22) Filed: Jan. 3, 2003

(65) Prior Publication Data

US 2003/0133848 A1 Jul. 17, 2003

(30) Foreign Application Priority Data

Jan. 17, 2002 (JP) ..... 2002-008786

(51) Int. Cl.[7] ..... B01L 9/06

(52) U.S. Cl. ..... 422/104; 422/99; 422/102; 422/50

(58) Field of Search ..... 422/65, 66, 99, 422/102, 104; 211/60.1, 74; 436/47

(56) References Cited

U.S. PATENT DOCUMENTS 5,985,219 A * 11/1999 Lind ..... 422/104

6,156,275 A * 12/2000 Dumitrescu et al. ..... 422/104

* cited by examiner

*Primary Examiner*—Jill Warden
*Assistant Examiner*—Paul Hyun
(74) *Attorney, Agent, or Firm*—Nixon & Vanderhye P.C.

(57) ABSTRACT

A test tube holder includes a test tube insertion adapter having an adapter body and an elastic ring. The adapter body includes a flange section which contacts an opening of the cylindrical hollow, an annular section which ranges with the flange section and is fitted on the inner surface of the opening, a plurality of flat spring sections whose proximal end portions are arranged at regular intervals along the circumference of the annular section and connected to the annular section and whose distal end portions extend inward in the cylindrical hollow and bent toward the axis of the adapter body, and contact sections which are formed on the inner surfaces of distal end portions of the flat spring sections. The elastic ring is provided to bind the flat spring sections together while surrounding the outer surfaces of the flat spring sections.

10 Claims, 3 Drawing Sheets

TEST TUBE HOLDER

CROSS-REFERENCE TO RELATED APPLICATIONS

This application is based upon and claims the benefit of priority from the prior Japanese Patent Application No. 2002-008786, filed Jan. 17, 2002, the entire contents of which are incorporated herein by reference.

BACKGROUND OF THE INVENTION

1. Field of the Invention

The present invention relates to a test tube holder that is capable of holding a test tube for keeping a specimen such as blood in an upright position and is suitable for conveying the test tube.

2. Description of Related Art

Conventionally test tube holders called columnar racks have been used a lot. The columnar racks each have a columnar base body made of synthetic resin. An engagement groove with which a guide rail of a conveyor belt are engaged and a control groove for controlling the conveyance of a test tube by the conveyor belt are formed on the outer surface of a proximal end portion of the columnar base body such that the test tube can easily be conveyed by the conveyor belt. The columnar base body has a cylindrical hollow for holding and keeping the test tube in an upright position at the core thereof.

In the conventional columnar rack or the test tube holder, the cylindrical hollow is so designed that its size matches that of a specific test tube. Therefore, the columnar rack or the test tube holder cannot be applied to a test tube of size (especially the outside diameter) different from that of the specific test tube.

BRIEF SUMMARY OF THE INVENTION

An object of the present invention is to provide a versatile test tube holder that is applicable to a plurality of test tubes having different outside diameters.

In order to attain the above object, the test tube holder according to the present invention has the following characteristic configuration. The other characteristic configurations will be clarified in the first and second embodiments later.

A test tube holder according to an aspect of the present invention, comprises a holder body including engagement sections which are formed on an outer surface of a proximal end portion of a columnar base body and which are to be engaged with conveying guide rails and a cylindrical hollow for holding a test tube, which is formed at a core of the columnar base body, and a test tube insertion adapter fitted into the cylindrical hollow of the holder body and provided to selectively hold test tubes whose outside diameters differ from each other, wherein the test tube insertion adapter includes an adapter body having a flange section which contacts an end face of an opening of the cylindrical hollow, an annular section which ranges with an inner circumference of the flange section and is fitted on an inner surface of the opening, a plurality of flat spring sections whose proximal end portions are arranged at regular intervals along a circumference of the annular section and connected to the annular section and whose distal end portions extend inward in the cylindrical hollow and bent toward an axis of the adapter body such that the adapter body is shaped like a funnel, and contact sections which are formed on inner surfaces of distal end portions of the flat spring sections, respectively and contact outer surfaces of the test tubes to be held, and an elastic ring with which the flat spring sections are bound together while surrounding outer surfaces of the flat spring sections in order to bring the contact sections of the adapter body into contact with the outer surfaces of the test tubes at given pressure.

When a test tube having a relatively small outside diameter is inserted in the test tube holder described above, it is held at one location (where the contact sections contact the test tube) of each of the flat spring sections of the test tube insertion adapter and another location (not shown) where the bottom of the cylindrical hollow contact the test tube by give holding force. When a test tube having a relatively large outside diameter is inserted therein, it is held at two locations (where the contact sections contact the test tube and the flat spring sections are bound with the elastic ring) of each of the flat spring sections of the test tube insertion adapter and at one location (not shown) where the bottom of the cylindrical hollow contact the test tube by the give holding force. Thus, the test tubes are held in appropriate holding manner and by appropriate holding force according to the size of the outside diameter of each of the test tubes.

DETAILED DESCRIPTION OF THE INVENTION (First Embodiment)

Figure 1:
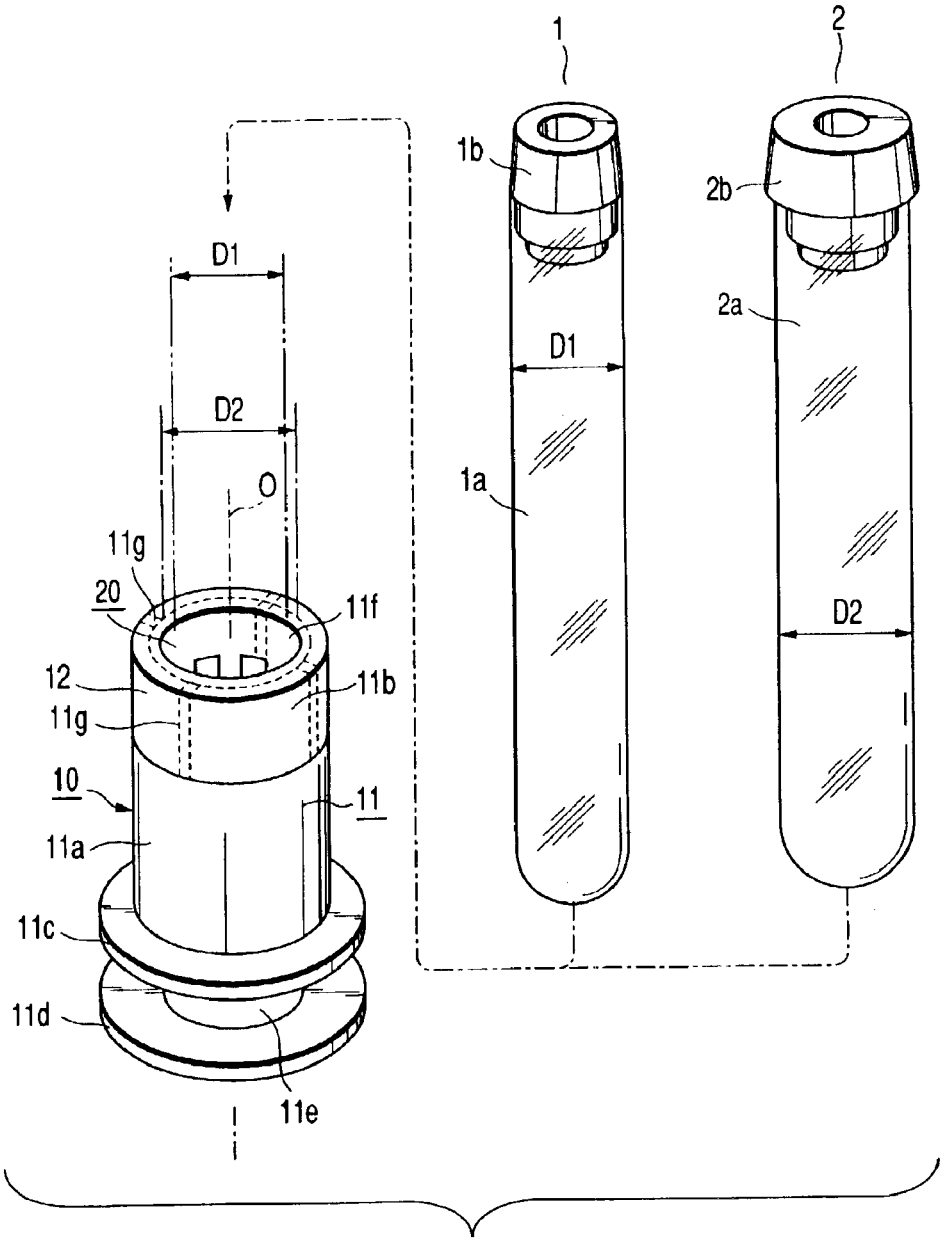
FIG. 1 is a perspective view schematically showing a configuration of a test tube holder according to a first embodiment of the present invention.

FIG. 1 shows a test tube holder according to a first embodiment of the present invention. The test tube holder includes a holder body 10 and a test tube insertion adapter 20 fitted into the holder body 10. Even though any one of a plurality of test tubes having different outside diameters (two test tubes 1 and 2 having different outside diameters D1 and D2 in the first embodiment) is inserted into the test tube holder, the adapter 20 can hold the inserted test tube with stability. The test tubes 1 and 2 include tube bodies 1*a* and 2*a*, respectively, and the openings of the tube bodies 1*a* and 2*a* are closed with caps 1*b* and 2*b*, respectively.

The holder body 10 includes engagement sections (two flanges 11*c* and 11*d* in the first embodiment), which are to be engaged with conveying guide rails (not shown), on the outer surface of a proximal end portion (a lower end portion) of a columnar base body 11 that is made of, e.g., synthetic resin. The holder body 10 also includes a cylindrical hollow 11*f* for holding a test tube at the core of the columnar base body 11. The hollow 11*f* has a given depth from the distal end (upper end) to the proximal end (lower end), the depth corresponding to a location where the flange 11*c* is provided.

The two flanges 11*c* and 11*d* of the engagement sections are provided to prevent the test tube holder from toppling due to vibrations or the like during the conveyance thereof. The flanges 11*c* and 11*d* are engaged with guide rails (not shown) arranged on both sides of a conveyer belt (not shown). An annular groove 11*e* is formed between the two flanges 11*c* and 11*d*. A stopping pin, which is driven by a piston/cylinder device (not shown) for controlling the conveyance of the holder, is inserted in the groove 11*e* to stop the test tube holder in a specific position of the conveyor belt.

The columnar base body 11 has a large-diameter section 11*a* on its middle part in the longitudinal direction and a small-diameter section 11*b* that ranges with the large-diameter section 11*a* and corresponds to the distal end portion of the columnar base body 11. A metallic fastening ring 12, which serves as an indicator for detecting the presence of the ring 12 by a photodetector or the like, is fitted on the small-diameter section 11*b*. A plurality of slits 11*g* (four slits in the first embodiment) are arranged on the small-diameter section in parallel in the longitudinal direction of the base body.

Figure 2A:
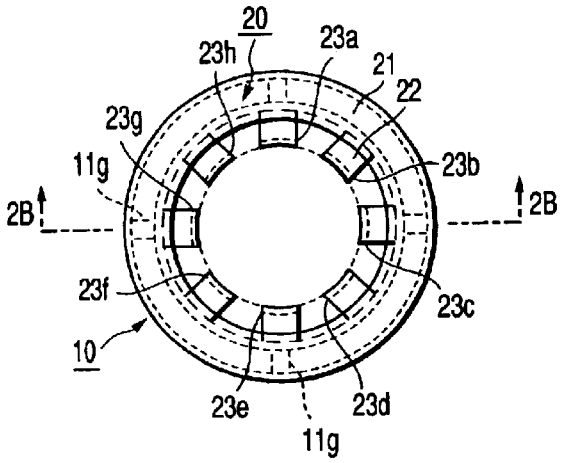
FIG. 2A is a top view specifically showing the configuration of the test tube holder according to the first embodiment of the present invention.
Figure 2B:
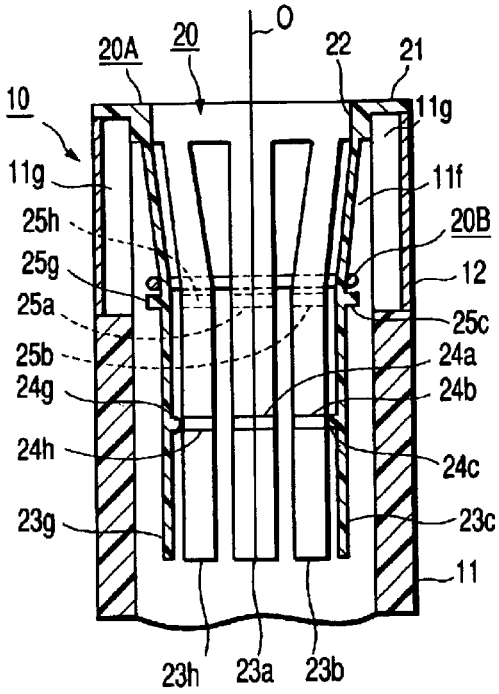
FIG. 2B is a cross-sectional view taken along line 2B—2B of FIG. 2A.

As illustrated in FIGS. 2A and 2B, the test tube insertion adapter 20 includes an adapter body 20A that is molded in one piece using elastic material such as synthetic resin and an elastic ring 20B mounted on the outer surface of the adapter body 20A.

The adapter body 20A includes a flange section 21, an annular section 22, a plurality of flat spring sections 23 (23*a* to 23*h*), and contact sections 24 (24*a* to 24*h*). The flange section 21 contacts the end face of the opening of the cylindrical hollow 11*f* of the holder body 10. The annular section 22 ranges with the inner circumference of the flange section 21 and is fitted on the inner surface of the opening. The proximal end portions of the flat spring sections 23 are arranged at regular intervals along the circumference of the annular section 22 and connected to the annular section 22, and the distal end portions thereof extend inward in the cylindrical hollow 11*f* and bend toward the axis O of the adapter body 20A such that the adapter body 20A is shaped like a funnel. The contact sections 24 are formed on the inner surfaces of the distal end portions of the flat spring sections 23, respectively and contact the outer surfaces of the test tubes 1 and 2 to be held.

The elastic ring 20B is used to bind the flat spring sections 23 together while surrounding the outer surfaces thereof. The contact sections 24 are therefore brought into contact with the outer surfaces of the test tubes 1 and 2 at given pressure.

Figure 3:
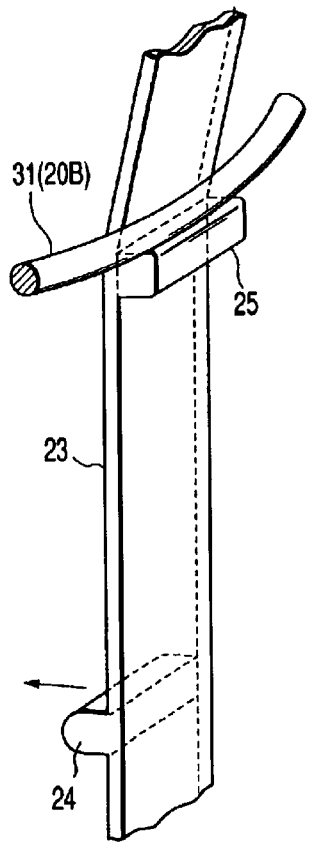
FIG. 3 is a perspective view showing a structure of a main part of a flat spring section of a test tube insertion adapter of the test tube holder according to the first embodiment of the present invention.

As shown in FIG. 3, the elastic ring 20B of the first embodiment is formed of an O-shaped ring 31 that is molded in one piece using elastic material such as rubber. The O-shaped ring 31 is provided to tightly bind the outer surfaces of the flat spring sections 23 by the elastic force thereof and bend the contact sections 24 toward the axis O of the adapter body 20A as indicated by the arrow in FIG. 3. The O-shaped ring 31 is stably held in a given position in the longitudinal direction of the flat spring sections 23 by projections 25 (25*a* to 25*h*) provided on the outer surfaces of at least some of the flat spring sections 23 (all of the flat spring sections 23 in the first embodiment).

Figure 4A:
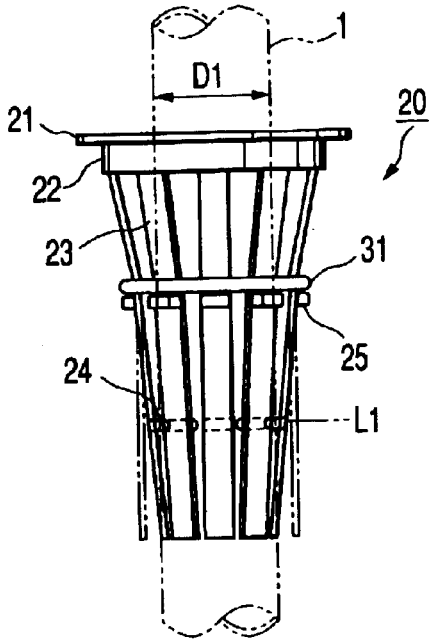
FIG. 4A is a side view of the test tube insertion adapter of the test tube holder according to the first embodiment of the present invention, in which a test tube whose outside diameter is relatively small is inserted.
Figure 4B:
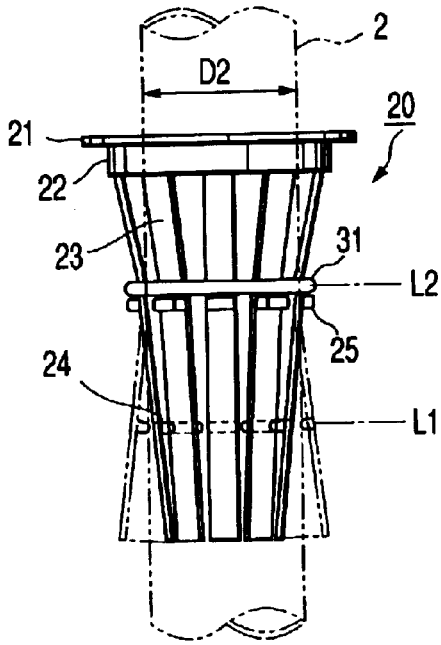
FIG. 4B is a side view of the test tube insertion adapter of the test tube holder according to the first embodiment of the present invention, in which a test tube whose outside diameter is relatively large is inserted.

The function of the test tube holder so configured will now be described with reference to FIGS. 4A and 4B.

Assume that the test tube 1 having a relatively small outside diameter D1 is inserted into the test tube holder with the test tube insertion adapter 20. All of the contact sections 24 of the adapter 20 are brought into contact with the outer surface of the test tube 1 as illustrated in FIG. 4A. Then, the distal end portions of the flat spring sections 23 are slightly expanded. Consequently, the test tube 1 is held in an axial position of the holder at given pressure that is exerted toward the axial direction of the holder by means of the contact sections 24.

Thus, the test tube 1 is supported at two locations of an intermediate level L1 at which the contact sections 24 contact the test tube and a bottom level L0 (not shown) at which the bottom of the cylindrical hollow 11*f* contacts the test tube. Since the test tube 1 having an outside diameter D1 is relatively light, it can be held with high stability in the holding manner and by the holding force as described above.

Assume that the test tube 2 having a relatively large outside diameter D2 is inserted into the test tube holder with the test tube insertion adapter 20. All of the contact sections 24 of the adapter 20 are brought into contact with the outer surface of the test tube 2 as illustrated in FIG. 4B. Then, the distal end portions of the flat spring sections 23 are greatly expanded. Consequently, the test tube 2 is held in an axial position of the holder at pressure that is greater than the above given pressure that is exerted toward the axial direction of the holder from the circumference thereof by means of the contact sections 24. Further, the inner surfaces of the flat spring sections, which are tightly bound with the O-shaped ring 31, are brought into contact with the outer surface of the test tube 2 at great force.

Thus, the test tube 2 is supported at three locations of an intermediate level L1 at which the contact sections 24 contact the test tube, a level L2 at which the flat spring sections are bound with the O-shaped ring 31, and a bottom level L0 (not shown) at which the bottom of the cylindrical hollow 11*f* contacts the test tube. Though the test tube 2 having an outside diameter D2 is relatively heavy, it can be held with high stability in the holding manner and by the holding force as described above.

(Second Embodiment)

Figure 5:
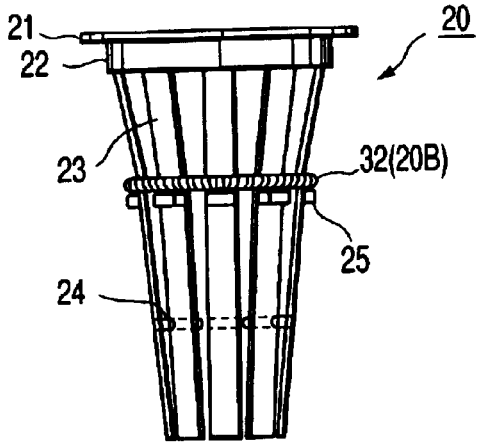
FIG. 5 is a side view showing a structure of a test tube insertion adapter of a test tube holder according to a second embodiment of the present invention.

FIG. 5 is a side view showing a structure of a test tube insertion adapter 20 of a test tube holder according to a second embodiment of the present invention. The second embodiment differs from the first embodiment in that an easily-assembling coil spring 32 is used in place of the elastic ring 20 for binding the flat spring sections together. Since the other components are the same as those of the first embodiment, their descriptions are omitted.

(Features of the Embodiments)

[1] A test tube holder according to the embodiments of the present invention, comprises:

- a holder body 10 including engagement sections 11*c* and 11*d* which are formed on the outer surface of a proximal end portion of a columnar base body 11 and engaged with conveying guide rails and a cylindrical hollow 11*f* for holding a test tube at the core of the columnar base body 11; and
- a test tube insertion adapter 20 fitted into the cylindrical hollow 11*f* of the holder body 10 and provided to selectively hold test tubes 1 and 2 whose outside diameters differ from each other, wherein the test tube insertion adapter 20 includes:

an adapter body 20A having:

- a flange section 21 which contacts the end face of an opening of the cylindrical hollow 11*f;*
- an annular section 22 which ranges with the inner circumference of the flange section 21 and is fitted on the inner surface of the opening;

a plurality of flat spring sections 23 (23*a* to 23*h*) whose proximal end portions are arranged at regular intervals along the circumference of the annular section 22 and connected to the annular section 22 and whose distal end portions extend inward in the cylindrical hollow 11*f* and bent toward the axis O of the adapter body such that the adapter body is shaped like a funnel; and contact sections 24 (24*a* to 24*h*) which are formed on the inner surfaces of the distal end portions of the flat spring sections 23, respectively and contact the outer surfaces of the test tubes 1 and 2 to be held; and an elastic ring 20B with which the flat spring sections 23 are bound together while surrounding the outer surfaces of the flat spring sections 23 in order to bring the contact sections 24 of the adapter body 20 into contact with the outer surfaces of the test tubes 1 and 2 at given pressure.

When the test tube 1 having a relatively small outside diameter D1 is inserted in the test tube holder described above, it is held at one location (where the contact sections 24 contact the test tube) of each of the flat spring sections 23 of the test tube insertion adapter 20 and another location (not shown) where the bottom of the cylindrical hollow 11*f* contact the test tube by give holding force. When the test tube 2 having a relatively large outside diameter D2 is inserted therein, it is held at two locations (where the contact sections 24 contact the test tube and the flat spring sections are bound with the elastic ring 20B) of each of the flat spring sections 23 of the test tube insertion adapter 20 and at one location (not shown) where the bottom of the cylindrical hollow 11*f* contact the test tube by the give holding force.

In the latter case, the amount of bend increases and so does the binding force of the elastic ring 20B at one location of each of the flat spring sections 23 (where the contact sections 24 contact the test tube). The test tube is held by holding force that is considerably greater than the given holding force in the former case.

Thus, the test tubes are held in appropriate holding manner and by appropriate holding force according to the size of the outside diameter of each of the test tubes. The above test tube holder can widely be used for test tubes having an outside diameter that is smaller than the inside diameter of the adapter body 20A even though the test tubes have an outside diameter other than the outside diameters D1 and D2.

[2] In the test tube holder according to the embodiments, described in the above paragraph [1], the adapter body 20A includes projections 25 (25*a* to 25*h*) on the outer surfaces of at least some of the flat spring sections 23 to hold the elastic ring 20B in a given position in a longitudinal direction of the flat spring sections 23.

In the test tube holder described above, the flat spring sections 23 can always be bound with the elastic ring 20B in a fixed position.

[3] In the test tube holder according to the embodiments, described in one of the above paragraphs [1] and [2], the adapter body 20A is molded in one piece using elastic material such as synthetic resin.

[4] In the test tube holder according to the embodiments, described in one of the above paragraphs [1], [2] and [3], the elastic ring 20B is formed of an O-shaped ring 31.

[5] In the test tube holder according to the embodiments, described in one of the above paragraphs [1], [2] and [3], the elastic ring 20B is formed of a coil spring 32.

(Modifications)

The test tube holder according to the above embodiments can be modified as follows:

The adapter body 20A of the test tube insertion adapter 20 can be formed of elastic metal material such as phosphor bronze instead of synthetic resin.

Two annular grooves are formed as engagement sections of the holder body 10 instead of two flanges 11*c* and 11*d*.

What is claimed is:

1. A test tube holder comprising:

a holder body including engagement sections which are formed on an outer surface of a proximal end portion of a columnar base body and which are to be engaged with conveying guide rails and a cylindrical hollow for holding a test tube, which is formed at a core of the columnar base body; and a test tube insertion adapter fitted into the cylindrical hollow of the holder body and provided to selectively hold test tubes whose outside diameters differ from each other, wherein the test tube insertion adapter includes:

an adapter body having;

a flange section which contacts an end face of an opening of the cylindrical hollow, an annular section which ranges with an inner circumference of the flange section and is fitted on an inner surface of the opening, a plurality of flat spring sections whose proximal end portions are arranged at regular intervals along a circumference of the annular section and connected to the annular section and whose distal end portions extend inward in the cylindrical hollow and bent toward an axis of the adapter body such that the adapter body is shaped like a funnel, and contact sections which are formed on inner surfaces of distal end portions of the flat spring sections, respectively and contact outer surfaces of the test tubes to be held; and an elastic ring with which the flat spring sections are bound together while surrounding outer surfaces of the flat spring sections in order to bring the contact sections of the adapter body into contact with the outer surfaces of the test tubes at given pressure.

2. The test tube holder according to claim 1, wherein the adapter body includes projections on outer surfaces of at least some of the flat spring sections to hold the elastic ring in a given position in a longitudinal direction of the flat spring sections.

3. The test tube holder according to claim 1, wherein the adapter body is molded in one piece using elastic material such as synthetic resin.

4. The test tube holder according to claim 2, wherein the adapter body is molded in one piece using elastic material such as synthetic resin.

5. The test tube holder according to claim 1, wherein the elastic ring is formed of an O-shaped ring.

6. The test tube holder according to claim 2, wherein the elastic ring is formed of an O-shaped ring.

7. The test tube holder according to claim 3, wherein the elastic ring is formed of an O-shaped ring.

8. The test tube holder according to claim 1, wherein the elastic ring is formed of a coil spring.

9. The test tube holder according to claim 2, wherein the elastic ring is formed of a coil spring.

10. The test tube holder according to claim 3, wherein the elastic ring is formed of a coil spring.

* * * * *